US011364528B2

(12) United States Patent
Rekieta et al.

(10) Patent No.: US 11,364,528 B2
(45) **Date of Patent: *Jun. 21, 2022**

(54) COILING HEAD APPARATUS AND SYSTEM

(71) Applicant: Reel Power Licensing Corp., Oklahoma City, OK (US)

(72) Inventors: Christopher D. Rekieta, Houston, TX (US); Joseph Henry, Oklahoma City, OK (US); David Lasswell, Yukon, OK (US); Earl Richardson, Houston, TX (US); Robert Allen, Houston, TX (US); Gary Donald Thompson, Broken Arrow, OK (US)

(73) Assignee: Reel Power Licensing Corp, Oklahoma City, OK (US)

( * ) Notice: Subject to any disclaimer, the term of this patent is extended or adjusted under 35 U.S.C. 154(b) by 307 days.

This patent is subject to a terminal disclaimer.

(21) Appl. No.: 16/435,003

(22) Filed: Jun. 7, 2019

(65) Prior Publication Data

US 2019/0291156 A1 Sep. 26, 2019

Related U.S. Application Data

(63) Continuation of application No. 15/712,499, filed on Sep. 22, 2017, now Pat. No. 10,357,814.

(60) Provisional application No. 62/399,006, filed on Sep. 23, 2016.

(51) Int. Cl.

| | |
|---|---|
| ***B65H 75/18*** | (2006.01) |
| ***B21C 47/04*** | (2006.01) |
| ***B65H 75/24*** | (2006.01) |
| ***B21F 3/00*** | (2006.01) |
| *H01F 41/04* | (2006.01) |

(52) U.S. Cl.

CPC ..... *B21C 47/04* (2013.01); *B21F 3/00* (2013.01); *B65H 75/18* (2013.01); *B65H 75/2484* (2021.05); *B65H 2701/30* (2013.01); *B65H 2701/33* (2013.01); *H01F 41/04* (2013.01)

(58) Field of Classification Search

CPC ..... B65H 75/18; B65H 75/24; B65H 75/242; B65H 75/248; B65H 75/2484; B21C 47/04

See application file for complete search history.

(56) References Cited

U.S. PATENT DOCUMENTS

| | | | |
|---|---|---|---|
| 777,780 | A | 12/1904 | Easton |
| 2,265,087 | A | 5/1941 | Tooke |
| 2,739,764 | A | 1/1954 | Lanstrom |
| 3,917,187 | A | 11/1975 | Damour |
| 3,937,412 | A | 2/1976 | Damour |

(Continued)

FOREIGN PATENT DOCUMENTS

| | | | |
|---|---|---|---|
| CN | 201567120 | U | 9/2010 |
| CN | 202316647 | U | 7/2012 |
| CN | 202539263 | U | 11/2012 |

(Continued)

*Primary Examiner* — Sang K Kim

(74) *Attorney, Agent, or Firm* — Phillips Murrah PC; Martin G. Ozinga

(57) ABSTRACT

The present invention is an apparatus, system and method for a new and improved coiling head utilized in wrapping elongated materials, which may have a zero and or near zero gap between leaves thereby reducing and or elimination indentations in the coiled elongated materials.

1 Claim, 10 Drawing Sheets

(56) References Cited

U.S. PATENT DOCUMENTS

| | | | | | |
|---|---|---|---|---|---|
| 4,124,173 | A | | 11/1978 | Damour | |
| 5,775,631 | A | * | 7/1998 | Murakami ..... | B65H 18/04<br>242/573.9 |

FOREIGN PATENT DOCUMENTS

| | | | |
|---|---|---|---|
| DE | 1211887 | B | 3/1966 |
| DE | 2138714 | A1 | 2/1973 |
| JP | S5691619 | U | 7/1981 |
| JP | S5699149 | A | 8/1981 |

* cited by examiner

COILING HEAD APPARATUS AND SYSTEM

CROSS-REFERENCE TO RELATED APPLICATIONS

The present application is a continuation of U.S. patent application Ser. No. 15/712,499 filed on Sep. 22, 2017, currently pending, in which priority is claimed from U.S. Provisional Application Ser. No. 62/399,006 filed on Sep. 23, 2016. The entire content of each of the above-referenced applications is hereby expressly incorporated herein by reference.

BACKGROUND OF INVENTION

1. Field of the Invention

In general, the present invention relates to an apparatus and or system used to coil lengths of hoses, cable, tubing, wiring and the like. More particularly, the present invention provides an improved coiling head that reduces and or eliminates damage such as indentations and kinks made from coiling around paddles with gaps between paddles as known in the prior art.

2. Description of the Prior Art

In general, lengths of material that are usually relatively long and flexible are wound on large reels and or spools by a manufacturer. It is known for redistribution to take these large reels and or spools of materials into smaller amounts for redistribution. The machines associated with such are often referred to as automatic cut and transfer coiling and or spooling machines. See Prior Art in FIG. 1. Spooling is typically a reference to taking the elongated material from a large spool and or reel to a smaller desired length for redistribution then wrapped around another spool and or reel for redistribution. Coiling is typically a reference to taking the elongated material from a large spool and or reel to a smaller desired length for redistribution and wrapping it freely into a coil with no spool and or reel.

Coiling is performed by wrapping the elongated materials around paddles having a circumference. Although the number of paddles on prior art coiling heads vary, it is typically four. This wrapping process is typically relatively tight around the paddles such that the coiled materials may not be easily removed from the coiling head. When the coiling is finished, the paddles are hinged such that they may collapse to a smaller circumference thus allowing the coiled material to be removed from the paddles.

In the prior art, the paddles are spaced such that the elongated materials do not have full contact around the circumference of the coil as may be seen in the Prior Art in FIG. 1. This may lead to damage such as but not limited to indentations and or kinks where the material sags between the paddles where the material is unsupported. Obviously, this is not desirable depending on the elongated material being coiled.

By example, but not to be considered limiting, medical tubing is often relatively small and flexible for use in medical, surgical, catheter, hypodermic applications, and so forth. This tubing is typically made by extrusion in large quantities wrapped around spools and or reels. Needless to say, the manufactured tube may be very long and a desired length for redistribution of the tubing may be just a few feet. Considering that medical tubing quality and precision may be a matter of life and death, it is highly undesirable to have tubing that gets kinked or otherwise damaged in the coiling process.

Thus, there is a need for a new and improved coiling head with zero and or near zero gaps in the circumference such that the elongated material being coiled is not damaged in the coiling process. It is desirable to fill these needs with a reliable alternative that is affordable and functional. The above discussed limitations in the prior art is not exhaustive. The current invention provides an inexpensive, time saving, more reliable apparatus, method and system where the prior art fails.

SUMMARY OF THE INVENTION

In view of the foregoing disadvantages inherent in the known types of coiling heads now present in the prior art, the present invention provides a new and improved apparatus, system and method of using the same. As such, the general purpose of the present invention, which will be described subsequently in greater detail, is to provide a new and improved coiling head for use with elongated materials, which has all the advantages of the prior art devices and none and or fewer of the disadvantages.

It is, therefore, contemplated that the present invention is an apparatus, system and method for a new and improved coiling head that may expand for a zero and or near zero gap while coiling, but may collapse for a smaller circumference for unloading the coiled elongated materials from the head.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved coiling head apparatus, system and method for use with elongated materials where it is desirable to prevent and or reduce indentations in same during the coiling process and the removal from the head.

Furthermore, an object of the present invention is to provide a new and improved coiling head apparatus, system and method, which allows for quick removal of the coiled materials from the head with a simple pull to collapse the head without the need of any tools.

Another object of the present invention is to provide a new and improved coiling head apparatus, system and method, which may be manufactured with three-dimensional printing and made from plastics.

It is a further object of the present invention to provide a new and improved coiling head apparatus, system and method, which is of a durable and reliable construction and may be utilized in numerous types of coiling applications.

An even further object of the present invention is to provide a new and improved coiling head apparatus, system and method, which is susceptible to a low cost of manufacture, which accordingly is then susceptible to low prices of sale to the consuming industry, thereby making such a system economically available to those in the industry.

Still another object of the present invention is to provide a new and improved coiling head apparatus, system and method, which provides all of the advantages of the prior art while simultaneously overcoming some of the disadvantages normally associated therewith.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings and appendices.

DETAILED DESCRIPTION OF INVENTION

Figure 1:
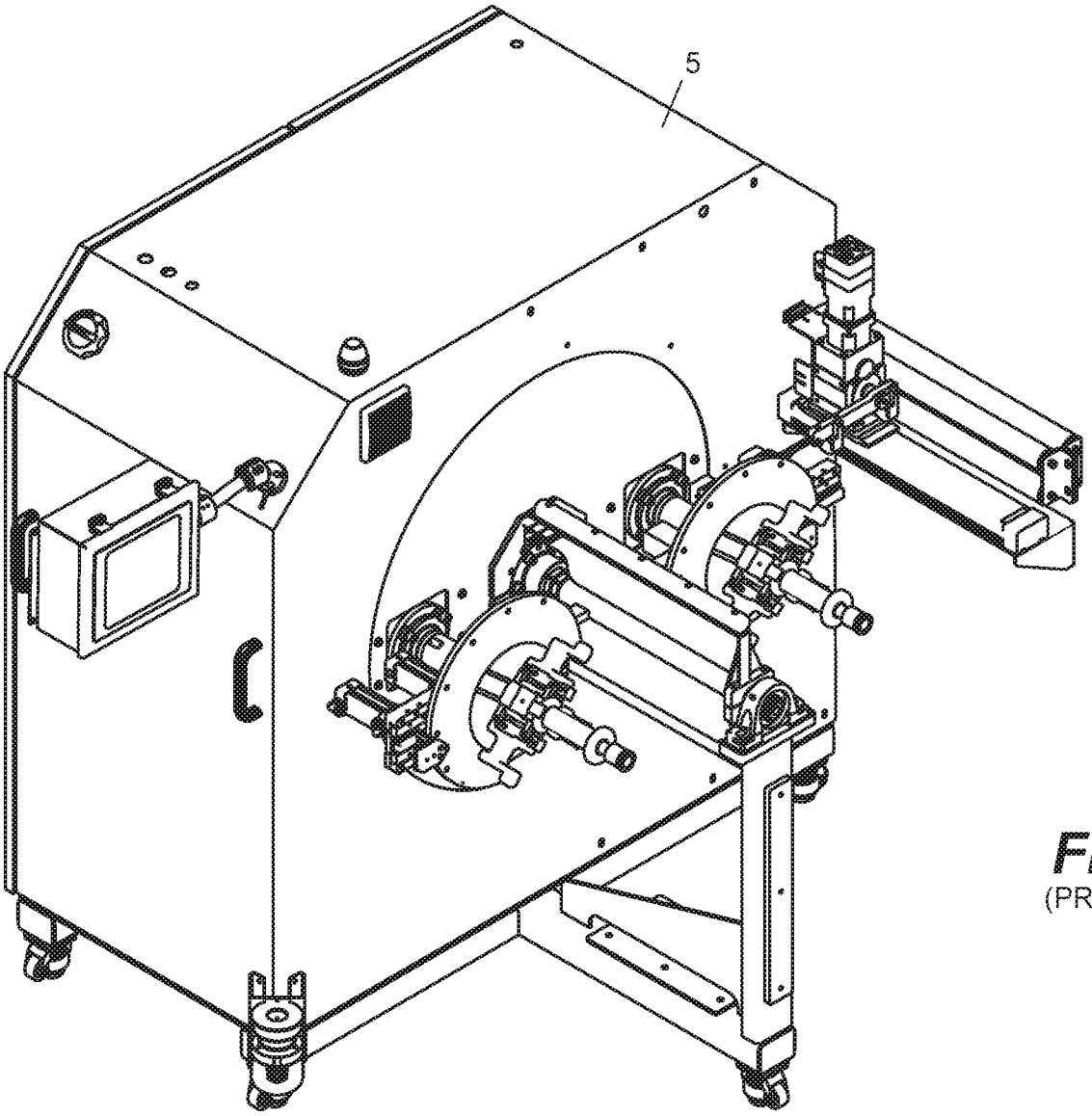
FIG. 1 (PRIOR ART)
FIG. 1 is a general illustration of a prior art automatic cut and transfer coiling machine and coiling head with two spindles and associated paddles.
Figure 2:
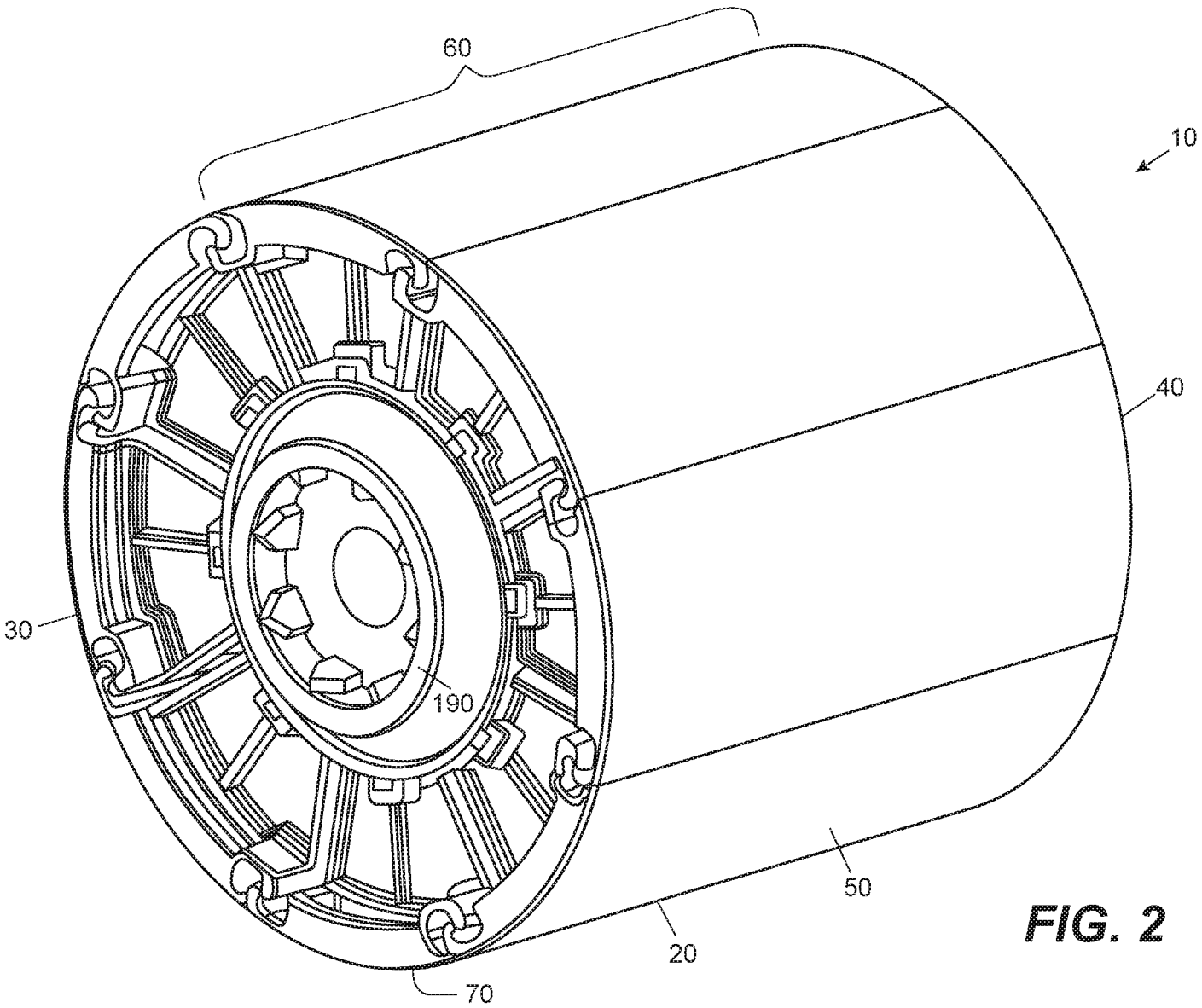
FIG. 2 is a perspective view illustration of a preferred embodiment of the invention generally depicting a coiling head fully expanded to receive an elongated material.
Figure 3:
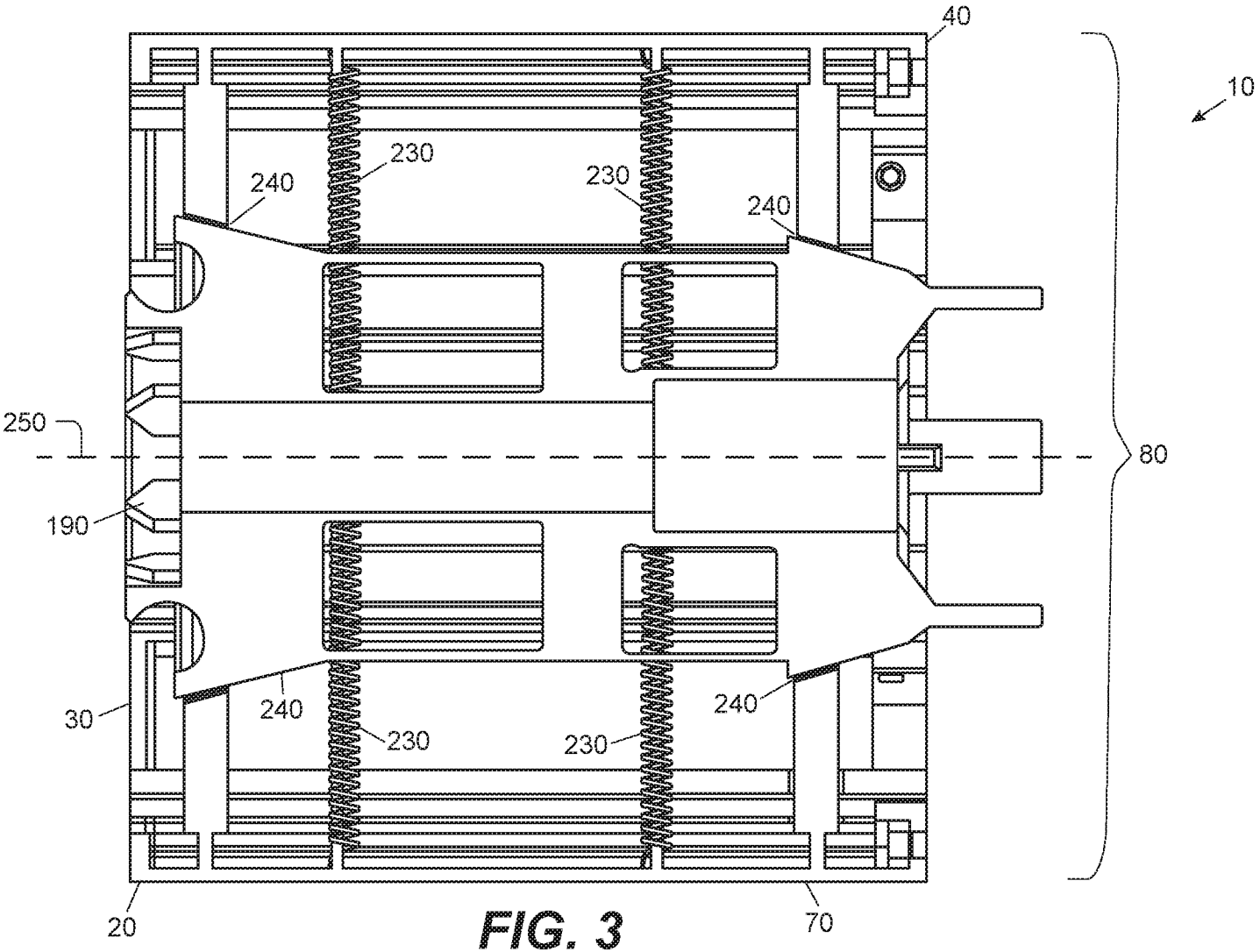
FIG. 3 is a cross section view of the embodiment of FIG. 2 illustration of a preferred embodiment of the invention generally depicting a coiling head fully expanded to receive an elongated material.
Figure 4:
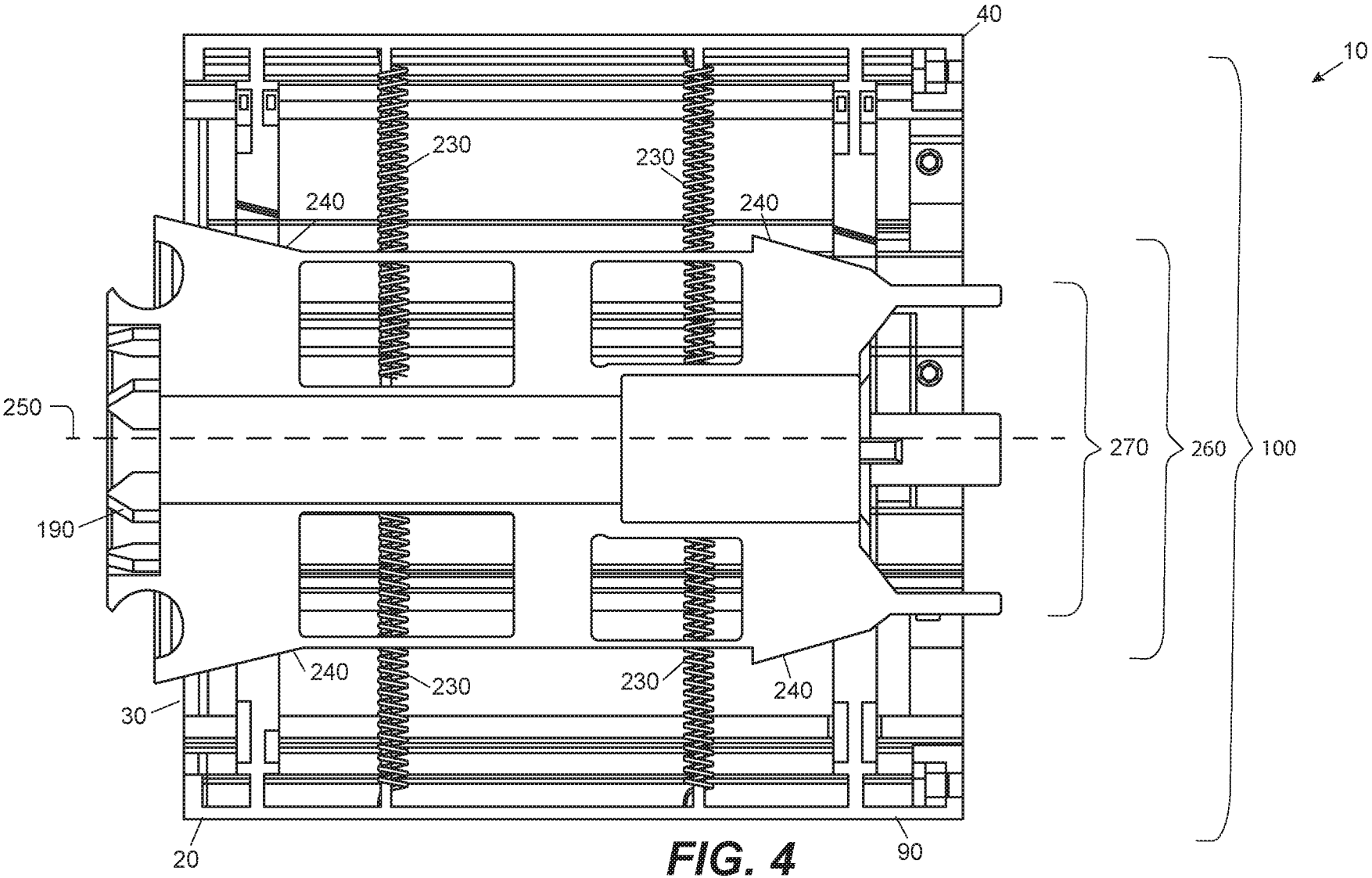
FIG. 4 is a cross section view of the embodiment of FIG. 2 illustration of a preferred embodiment of the invention generally depicting a coiling head collapsed for removing an elongated material.
Figure 5:
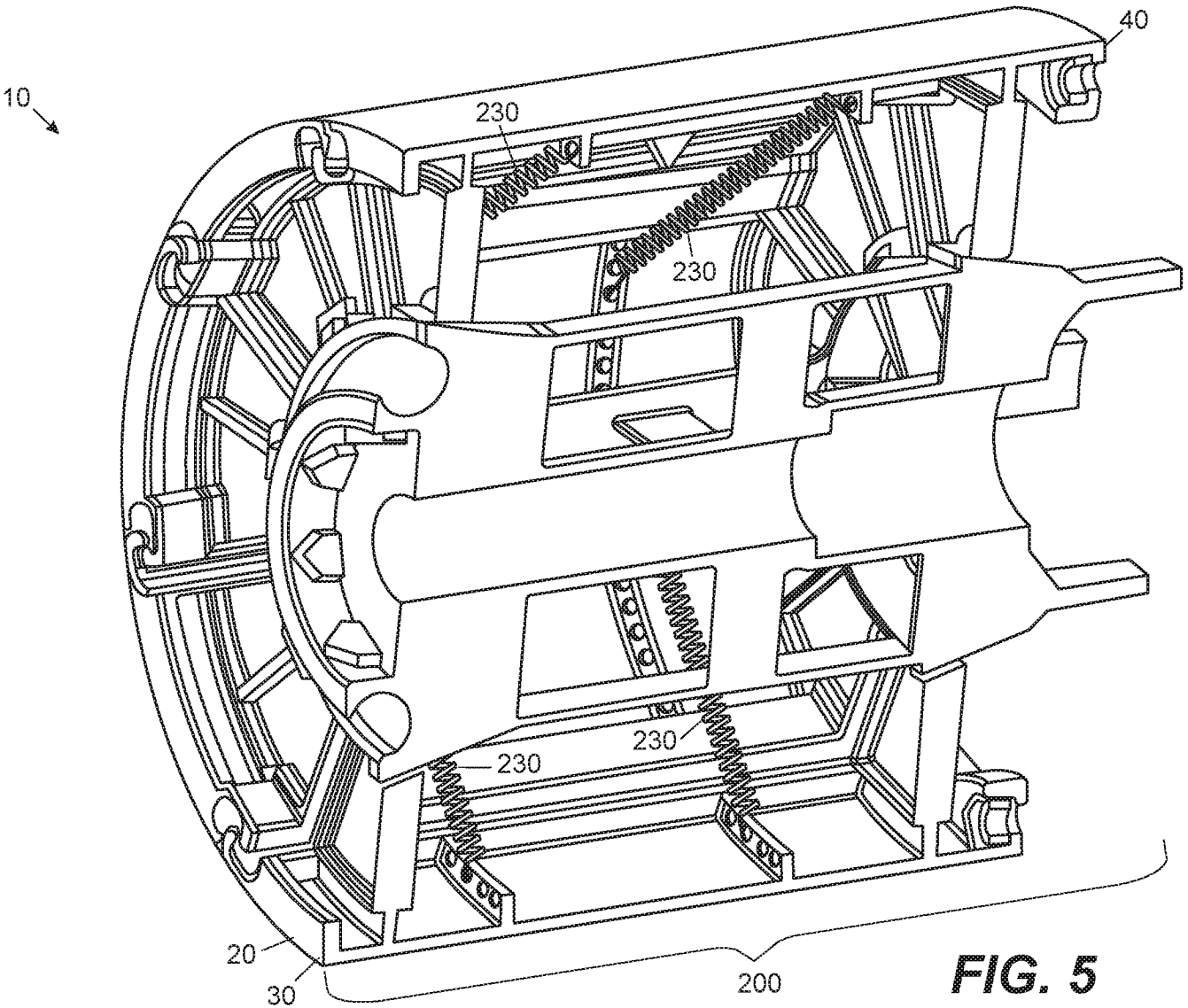
FIG. 5 is a cross section perspective view of the embodiment of FIG. 2 illustration of a preferred embodiment of the invention generally depicting a coiling head fully expanded to receive an elongated material.
Figure 6:
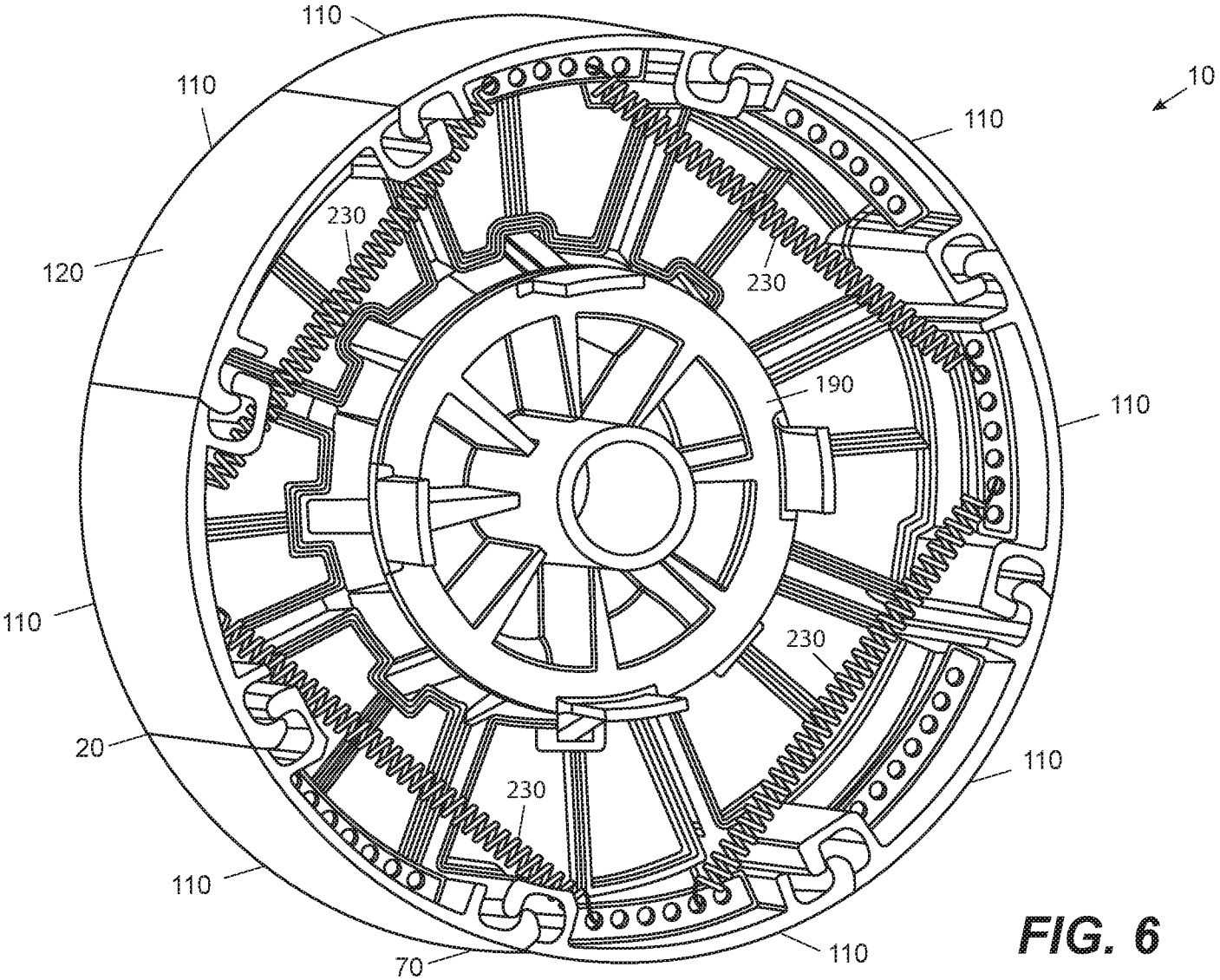
FIG. 6 is a cross section perspective view illustration of a preferred embodiment of the invention generally depicting a coiling head fully expanded to receive an elongated material and generally depicting the back of the wedge that would engage the coiling machine.
Figure 7:
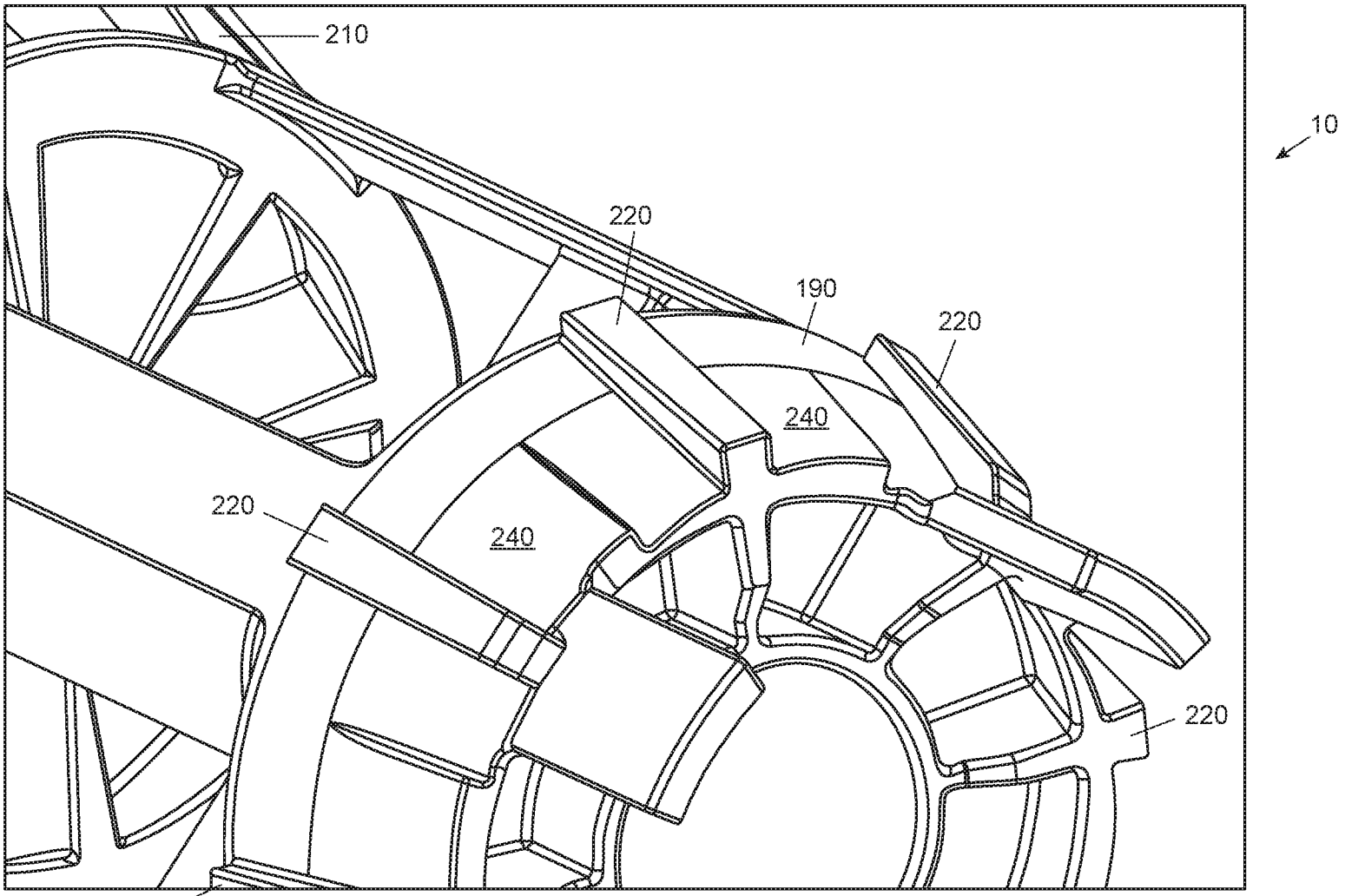
FIG. 7 is a perspective view partial illustration of a preferred embodiment of the invention generally depicting a wedge not attached to the leaves.
Figure 8:
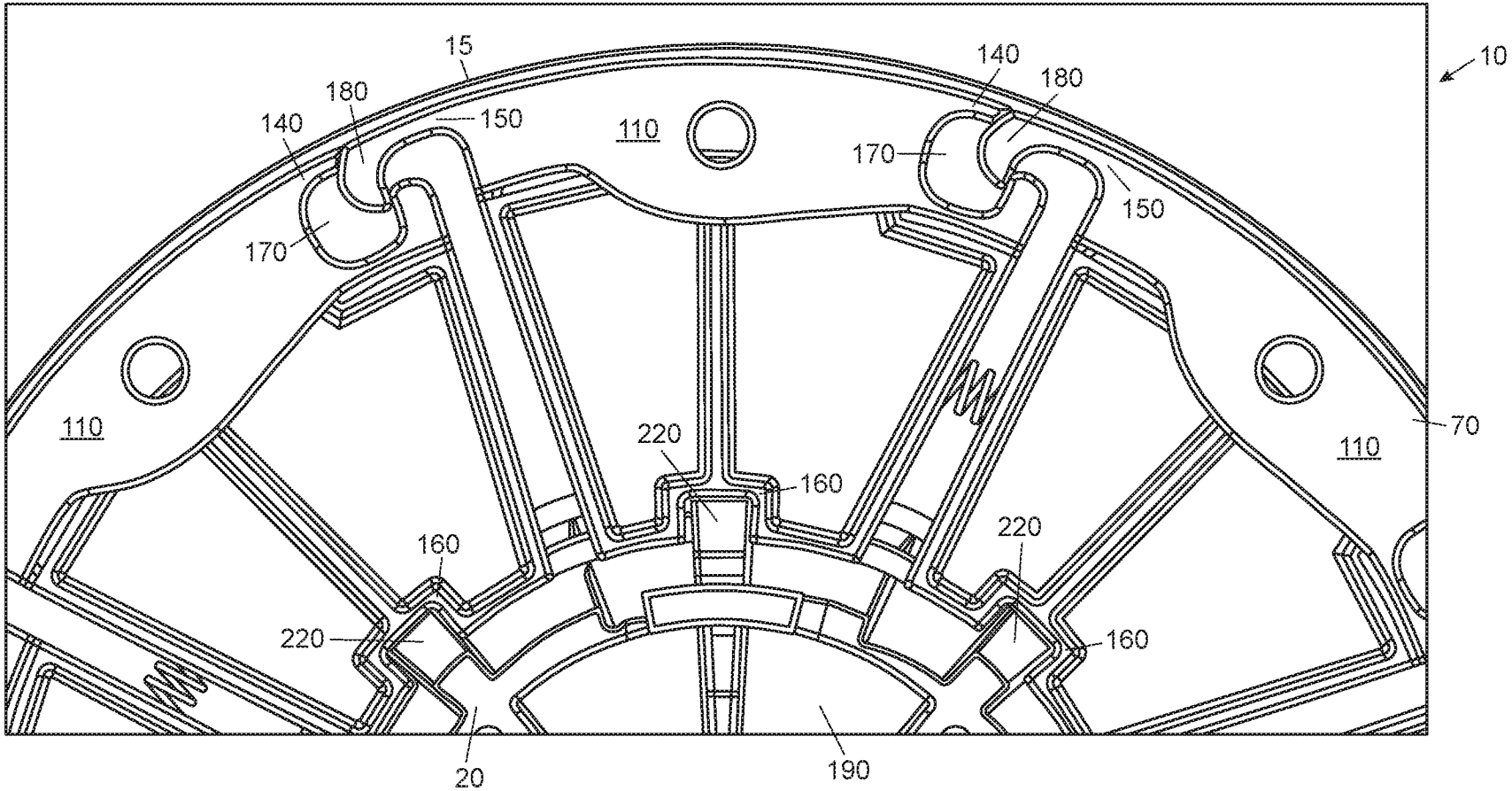
FIG. 8 is an end view partial illustration of a preferred embodiment of the invention generally depicting a fully expanded coiling head with an elongated material being received thereon.
Figure 9:
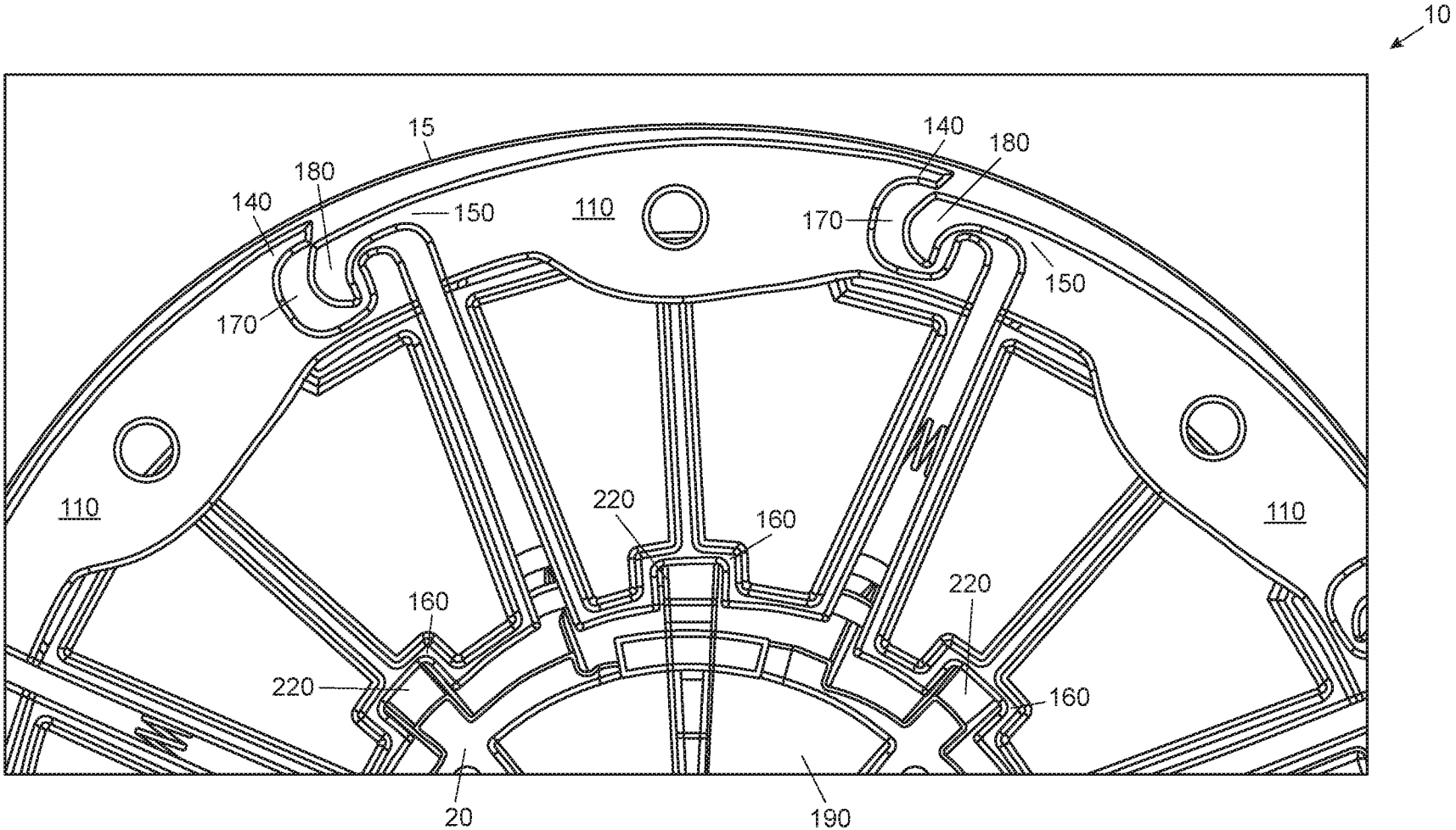
FIG. 9 is an end view partial illustration of a preferred embodiment of the invention generally depicting a partially collapsed coiling head with an elongated material thereon.
Figure 10:
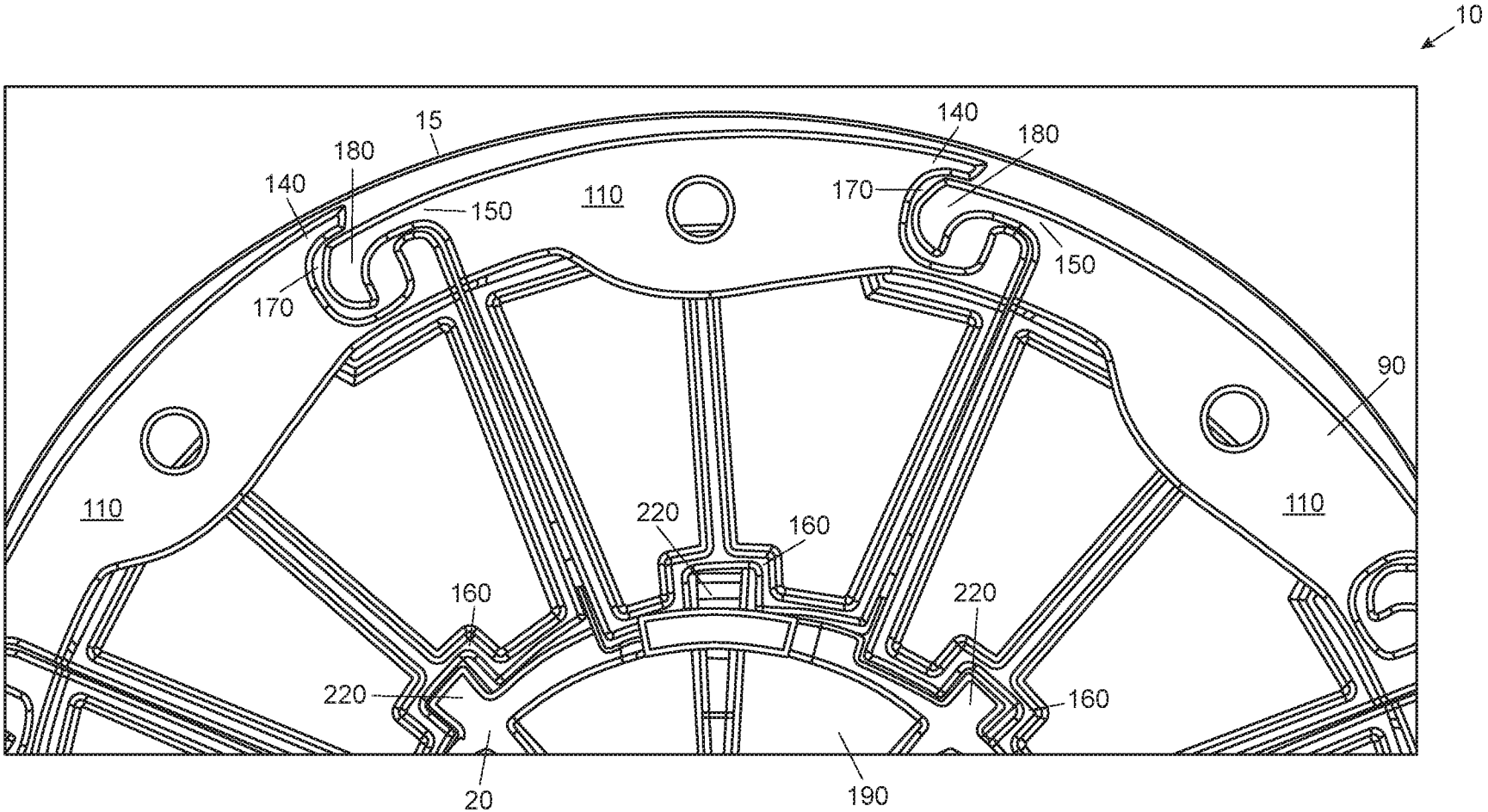
FIG. 10 is an end view partial illustration of a preferred embodiment of the invention generally depicting a fully collapsed coiling head with an elongated material ready to be removed from the coiling head.

Referring to the illustrations, drawings, and pictures, and to FIG. 2 through 10 in particular, reference character 10 generally designates a new and improved coiling head apparatus, system and method of using the same constructed in accordance with the present invention. Invention 10 is generally used with elongated materials 15 needing to be made into smaller segments for distribution from a larger spool and or reel. Elongated materials 15 may be but is not limited to electrical cables, steel cables, wire cables, hoses and so forth. It is contemplated that invention 10 may be utilized with prior art devices 5 such as depicted in FIG. 1. For purposes of convenience, the reference numeral 10 may generally be utilized for the indication of the invention, portion of the invention, preferred embodiments of the invention and so on. It is also to be understood that invention 10 should not be considered limited to just a coiling head and the terms should not be considered to limit the invention to such.

Invention 10 may generally include coiling head 20 that may be mounted to a prior art automatic cut and transfer coiling machine 5 as depicted in FIG. 1. Head 20 may have a front and or first end 30, a back and or second end 40, a side wall 50 with a length 60 defined as between first end 30 and second end 40. Head 20 may have an expanded and or first position 70 with a first diameter 80 and a collapsed and or second position 90 with a second diameter 100 that may be smaller than first diameter 80 when desired.

Head 20 may be configured from leaves 110 such as but not limited to eight in configuration to make head 20. It is understood that more or less leaves 110 may be utilized. Leaves 110 may have a top 120, a first side 140, a second side 150 and a bottom 160. Leaves 110 may further have a slot 170 on said first side 140, and a tongue 180 on said second side 150.

Coiling head 20 may further have a wedge 190 having a length 200. Wedge 190 may have twisted wedge surface 210, ridge 220, springs 230 and ramps 240. Twisted wedge surface 210 may have, but is not limited to, eight surfaces in configuration. Ridge 220 may have, but is not limited to, eight ridges in configuration. It is understood that more or less twisted wedge surface 210 and ridge 220 may be utilized. Horizontal axis 250 runs along the length 200 of wedge 190. It is contemplated wedge 190 may further contain a first or larger diameter 260 and a second or smaller diameter 270.

Wedge 190 may move in and out along the axis 250. When wedge 190 moves in, the leaves 110 fully expand to first position having larger diameter 260 creating a solid circumference for the elongated material 15 to wrap around. When the leaves 110 are expanding, tongue 180 slides in slot 170 and may lock in place. When wedge 190 moves out, leaves 110 collapse to second position having smaller diameter 270 as springs 230 pull leaves 110 inward. When leaves 110 collapse, the bottom 160 slides along ramps 240. As the bottom 160 slides along ramps 240, the tongue 180 also slides along slot 170 until smaller diameter 270 is reached. It is contemplated wedge surface 210 may impart a twisting motion on leaves 110 as they travel along ramps 240 to smaller diameter 270 and larger diameter 260. It is also contemplated ridge 220 may also impart a twist and or rotation to leaves 110 as they expand and collapse, which will prevent relative rotation of the leaves 110. It is contemplated wedge 190 may further contain an inner radius and an outer radius.

It is understood that as wedge 190 drops away from the leaves 110, leaves 110 may slide under each other. Springs 230 and the rotation of leaves 110 may be caused by the loss of support and/or guided support of wedge 190. It is also contemplated that if the sliding of leaves 110 into each other does not follow the wedge 190 exactly, springs 230 may allow compliance so the leaves 110 can keep from binding.

In Operation

Automatic cut and transfer coiling machine 5 may be fitted with coiling head 20 on each spindle as known in the art. When coiling head 20 is ready to receive elongated material 15, coiling head 20 wedge 190 is generally pushed in to expand leaves 110 thereby eliminating and our reducing any gaps between leaves 110.

When it is time to remove elongated material 15 from coiling head 20, wedge 190 is pulled out allowing leaves 110 to collapse thereby removing the tension of elongated material 15 around leaves 110.

After removal of elongated material 15, wedge 190 is pushed back again for fully expanding leaves 110 in preparation for receiving more elongated material 15.

It is therefore contemplated that invention 10 may be and or consist of a coiling head for an automatic cut and transfer coiling machine comprising at least two leaves having a bottom, a first side, a second side and a rounded top side wherein said rounded top has a first side having a tongue and a second side having a slot, wherein rounded top of said at least two leaves are adapted to selectively form a circumference for engaging elongated material, and wherein said circumference has a perpendicular axis; a cylindrical wedge having an axis along said axis of said circumference for engaging elongated material, said cylindrical wedge adapted to engage a spindle of said automatic cut and transfer coiling machine, and a conical outer surface adapted to engage said bottom of said at least two leaves; and wherein when said cylindrical wedge is adapted to selectively push said at least two leaves away from said axis of said cylindrical wedge when pushed in one direction along said axis of said cylindrical wedge and to push toward said axis of said cylindrical wedge when pushed in opposite of said direction.

Changes may be made in the combinations, operations, and arrangements of the various parts and elements described herein without departing from the spirit and scope of the invention. Furthermore, names, titles, headings and general division of the aforementioned are provided for convenience and therefore, should not be considered limiting.

What is claimed:

1. A coiling head for an automatic cut and transfer coiling machine comprising:

at least two leaves having a bottom, a first side, a second side and a rounded top side wherein said rounded top has a first side having a tongue and a second side having a slot, wherein rounded top of said at least two leaves are adapted to selectively form a circumference for engaging elongated material, and wherein said circumference has a perpendicular axis;

a cylindrical wedge having an axis along said axis of said circumference for engaging said elongated material, said cylindrical wedge is made to engage a spindle of said automatic cut and transfer coiling machine, and a conical outer surface adapted to engage said bottom of said at least two leaves; and wherein when said cylindrical wedge is a adapted to selectively push said at least two leaves away from said axis of said cylindrical wedge when pushed in one direction along said axis of said cylindrical wedge and to push toward said axis of said cylindrical wedge when pushed in opposite of said direction.

* * * * *